US005409209A

United States Patent [19]

Nakamura et al.

[11] Patent Number: 5,409,209

[45] Date of Patent: Apr. 25, 1995

[54] SHEET DELIVERY MECHANISM FOR A PRINTER

[75] Inventors: Shinya Nakamura; Takashi Norigoe; Teruyuki Ochiai; Yoshiaki Tanaka, all of Shizuoka, Japan

[73] Assignee: Tokyo Electric Co., Ltd., Tokyo, Japan

[21] Appl. No.: 71,275

[22] Filed: Jun. 4, 1993

[30] Foreign Application Priority Data

| | | | |
|---|---|---|---|
| Jun. 4, 1992 | [JP] | Japan | 4-144471 |
| Jun. 4, 1992 | [JP] | Japan | 4-144472 |
| Jun. 12, 1992 | [JP] | Japan | 4-153122 |
| Jul. 22, 1992 | [JP] | Japan | 4-195382 |
| Jul. 22, 1992 | [JP] | Japan | 4-195383 |

[51] Int. Cl.[6] ..... B65H 5/16

[52] U.S. Cl. ..... 271/271; 271/188; 271/209; 271/314

[58] Field of Search ..... 271/188, 209, 271, 314; 400/642, 644

[56] References Cited

U.S. PATENT DOCUMENTS

| | | | |
|---|---|---|---|
| 3,934,872 | 1/1976 | Honkawa | 271/188 |
| 4,469,319 | 9/1984 | Robb | 271/188 X |
| 4,593,894 | 6/1986 | Woods | 271/188 X |
| 4,728,963 | 3/1988 | Rasmussen | 271/209 X |
| 4,767,114 | 8/1988 | Nishimoto | 271/188 X |
| 4,844,633 | 7/1989 | Greenberg . | |
| 4,874,161 | 10/1989 | Murasaki | 271/265 |
| 5,248,210 | 9/1993 | Schulz | 271/271 X |

FOREIGN PATENT DOCUMENTS

| | | |
|---|---|---|
| 0480719 | 4/1992 | European Pat. Off. . |
| WO90/09891 | 9/1990 | WIPO . |

OTHER PUBLICATIONS

Recording Apparatus; Cannon Inc.; Shigeru Okamura JP Patent No. 1-226379 Sep. 11, 1989; Application No. 63-51667 Mar. 7, 1988 (Abstract).

Sheet Supply Device; Daiwa Seiko Inc; Akira Nakamura JP No. 3-238262 Oct. 24, 1991; Application No. 2-30312 Feb. 9, 1990 (Abstract).

*Primary Examiner*—David H. Bollinger

*Attorney, Agent, or Firm*—Oblon, Spivak, McClelland, Maier, & Neustadt

[57] ABSTRACT

A sheet passage is formed so as to extend from a sheet feed position via a printing position to a sheet delivery position, delivery rollers driven by a driving unit are disposed between the printing position and the sheet delivery position on the sheet passage, pressure rollers are disposed on one side of the sheet passage so as to be in contact respectively with the delivery rollers disposed on the other side of the sheet passage, a back sheet guide is disposed between the delivery rollers and the sheet delivery position, and a printed sheet delivered by the delivery rollers and guided by the back sheet guide is transferred to a printed sheet storage unit by sheet transfer arms. Thus, the time required to transfer the printed sheet from the delivery rollers to the printed sheet storage unit is extended so that the time between the delivery of the preceding sheet to the printed sheet storage unit and the delivery of the succeeding sheet to the printed sheet storage unit is extended to prevent the smearing of the preceding printed sheet previously stored in the printed sheet storage unit with the ink by the succeeding printed sheet.

14 Claims, 15 Drawing Sheets

SHEET DELIVERY MECHANISM FOR A PRINTER

BACKGROUND OF THE INVENTION

1. Field of the Invention

The present invention relates to a sheet delivery mechanism for a printer, such as an ink-jet printer.

2. Description of the Related Art

A well-known sheet delivery mechanism incorporated into an ink-jet printer is shown in FIG. 16. The ink-jet printer has a substantially U-shaped sheet passage 103 extending from a sheet feed position 100 via a printing position 101 to a sheet delivery position 102.

An ink-jet print head 2 is disposed at the printing position 101. The ink-jet print head 2 is mounted on a carriage, not shown, and reciprocated in directions perpendicular to a sheet feed direction. The ink-jet print head 2 jets ink particles on a sheet P for printing in synchronism with the reciprocating movement of the ink-jet print head 2 and the advancement of the sheet P.

A feed roller 3 feeds, in cooperation with a leaf plate 4, a sheet P from a sheet feed tray 6 disposed at the sheet feed position 100 or a sheet P inserted by hand into a hand-feed passage 110 toward the ink-jet print head 2. The feed roller 3 rotates in the direction of the arrow (FIG. 16) to feed the sheet pressed thereto by the leaf plate 4 toward the ink-jet print head 2.

A sheet delivery mechanism 10A for delivering a printed sheet P printed by the ink-jet print head 2 comprises a delivery roller 11 for advancing the printed sheet P in a delivering direction indicated by the arrow E, and a pressure roller 12 for pressing the printed sheet P against the delivery roller 11. The delivery roller 11 is disposed behind the ink-jet print head 2 on the sheet passage 103 and supported for rotation in the direction of the arrow (FIG. 16). The pressure roller 12 is biased by a spring or the like toward the delivery roller 11 to press the printed sheet P against the delivery roller 11. The pressure roller 12, in general, comprises spur wheels each having a saw-toothed circumference to avoid the transfer of the ink from the printed sheet P to the pressure roller 12.

The feed roller 3 rotates to pull out a sheet P from the sheet feed tray 6 and to insert the sheet P in the sheet passage 103, and the ink-jet print head 2 prints characters or the like on the sheet P in a portion of the sheet P positioned opposite to the ink-jet print head 2. Then, the printed sheet P is delivered by the cooperative action of the delivery roller 11 and the pressure roller 12 to a delivery tray 15 disposed at the delivery position 102. The printed sheet P is placed in the delivery tray 15 with its printed surface facing up.

In FIG. 16, denoted by 19 is a sheet guide serving also as a platen for supporting the sheet P in a flat state and guiding the same to the delivery roller 11.

Problems in this related art will be described hereinafter. When the printed sheet P is delivered to the delivery tray 15 by the delivery roller 11 of the sheet delivery mechanism of the printer shown in FIG. 16, the printed sheet P slides along the printed surface of the printed sheet P printed in the preceding printing cycle and stored in the delivery tray 15. Accordingly, if the ink printed on the preceding printed sheet P is half dried, the printed surface of the preceding printed sheet P previously stored in the delivery tray 15 and the backside of the succeeding printed sheet P are smeared. Such a problem has become increasingly remarkable in recent years in which printing speed has been progressively increased and a plurality of kinds of ink have become used selectively for versatile printing modes.

To solve such a problem, a printer capable of delivering printed sheet P so that the same will not touch the preceding printed sheet P is proposed in U.S. Pat. No. 4,728,963.

As shown in FIGS. 17 and 18, the sheet delivery mechanism of this previously proposed printer has a platen 19A supported for turning in the direction of the arrow, and a printed sheet storage unit having top rails 9A for temporarily supporting a printed sheet P in a horizontal position. The platen **19*a* is turned in the direction of the arrow when delivering the printed sheet P to allow the printed sheet P to fall by gravity from the top rails 9A** into the stacker, not shown, of the printed sheet storage unit.

The ratio of an area for installing the printed sheet storage unit 9A to an area required for installing the printer is large, the size of the printer is increased inevitably and the printer cannot be miniaturized.

SUMMARY OF THE INVENTION

Accordingly, it is a first object of the present invention to provide a sheet delivery mechanism for a printer, having a small construction and capable of preventing smearing the printed sheet when delivering the same.

A second object of the present invention is to provide a sheet delivery mechanism for a printer, capable of surely delivering a sheet to a delivery position.

A third object of the present invention is to provide a sheet delivery mechanism for a printer, capable of delivering a sheet without generating noise.

A fourth object of the present invention is to provide a sheet delivery mechanism for a printer, facilitating the removal of sheets jammed in a sheet passage.

A fifth object of the present invention is to provide a sheet delivery mechanism for a printer, capable of being easily assembled.

According to the present invention, a sheet passage is formed so as to extend from a sheet feed position via a printing position to a sheet delivery position, delivery rollers driven by a driving unit are disposed between the printing position and the sheet delivery position on the sheet passage, pressure rollers are disposed on one side of the sheet passage so as to be in contact respectively with the delivery rollers disposed on the other side of the sheet passage, a back sheet guide is disposed between the delivery roller and the sheet delivery position, and a printed sheet delivered by the delivery rollers is transferred to a printed sheet storage unit disposed at the sheet delivery position by sheet transfer arms. Thus, the time required to transfer the sheet from the delivery rollers to the printed sheet storage unit is extended so that the time between the delivery of the preceding sheet to the printed sheet storage unit and the delivery of the succeeding sheet to the printed sheet storage unit is extended. Accordingly, the ink printed on the preceding sheet dries up before the succeeding sheet slides along the printed surface of the preceding sheet and, consequently, the sheets delivered to the printed sheet storage unit are not smeared with the ink.

DETAILED DESCRIPTION OF THE PREFERRED EMBODIMENTS

Figure 16:
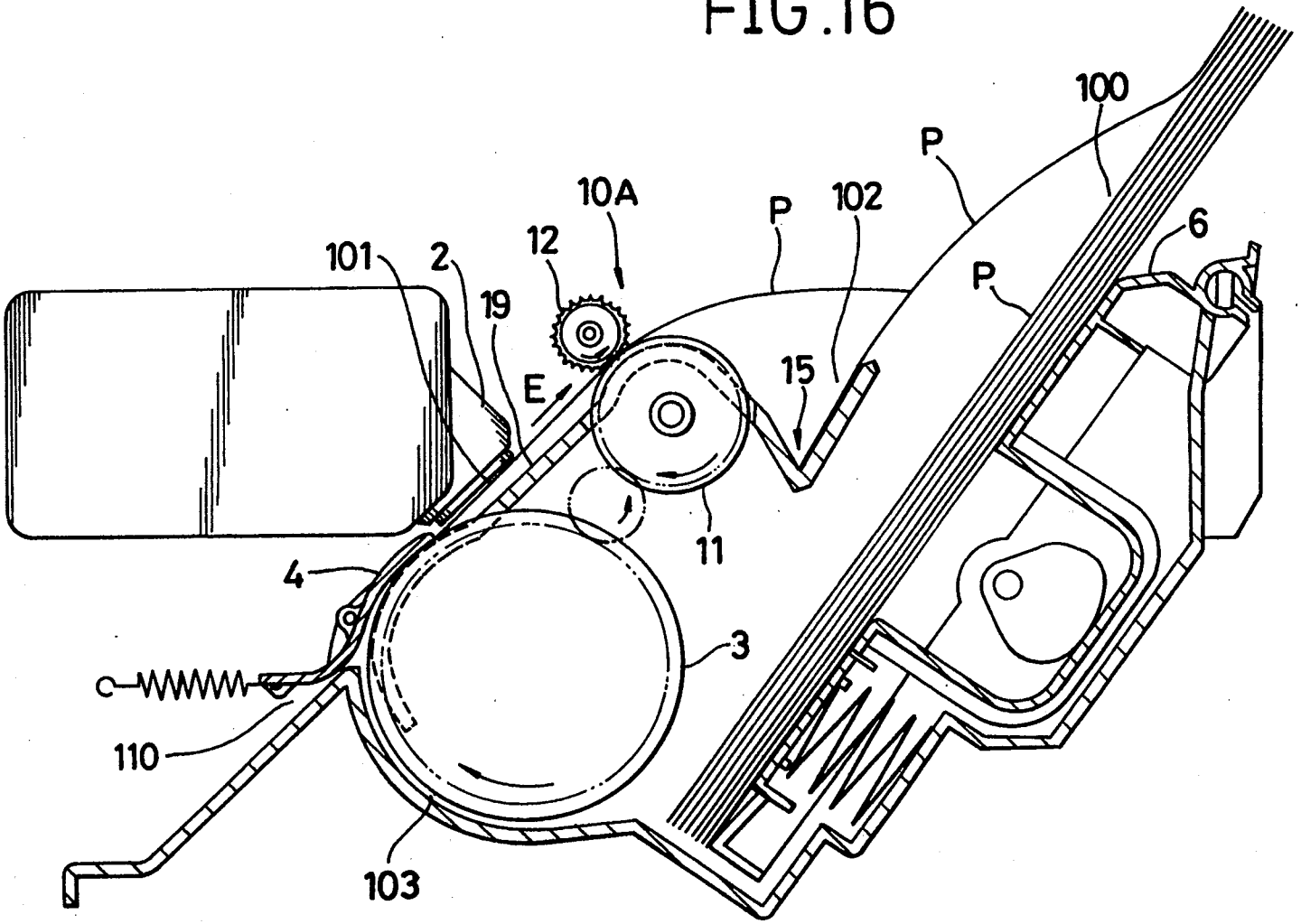
FIG. 16 is a longitudinal sectional view of a known sheet delivery mechanism incorporated into an ink-jet printer.
Figure 17:
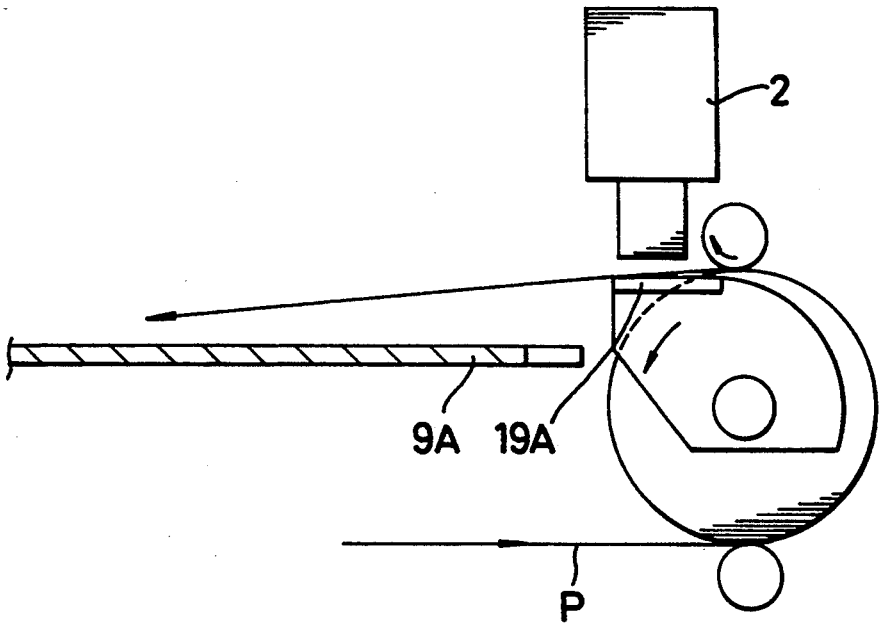
FIG. 17 is a side view of another known sheet delivery mechanism incorporated into an ink-jet printer.
Figure 18:
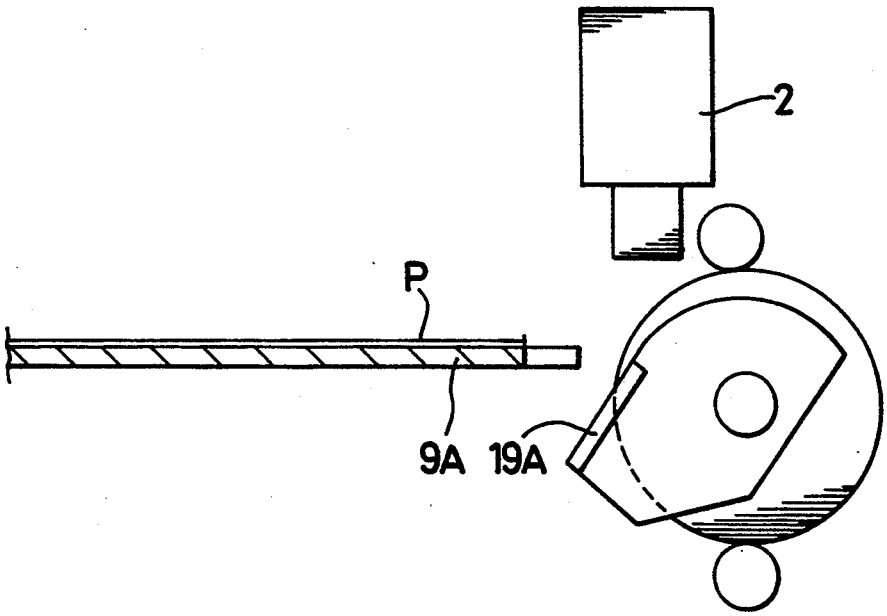
FIG. 18 is a side view of assistance in explaining the sheet delivering operation of the sheet delivery mechanism of FIG. 17.

A sheet delivery mechanism in a first embodiment according to the present invention will be described hereinafter with reference to FIGS. 1 to 8. In the following description, parts like or corresponding to those previously described with reference to FIG. 16 are denoted by the same reference characters and the description thereof will be omitted.

Figure 1:
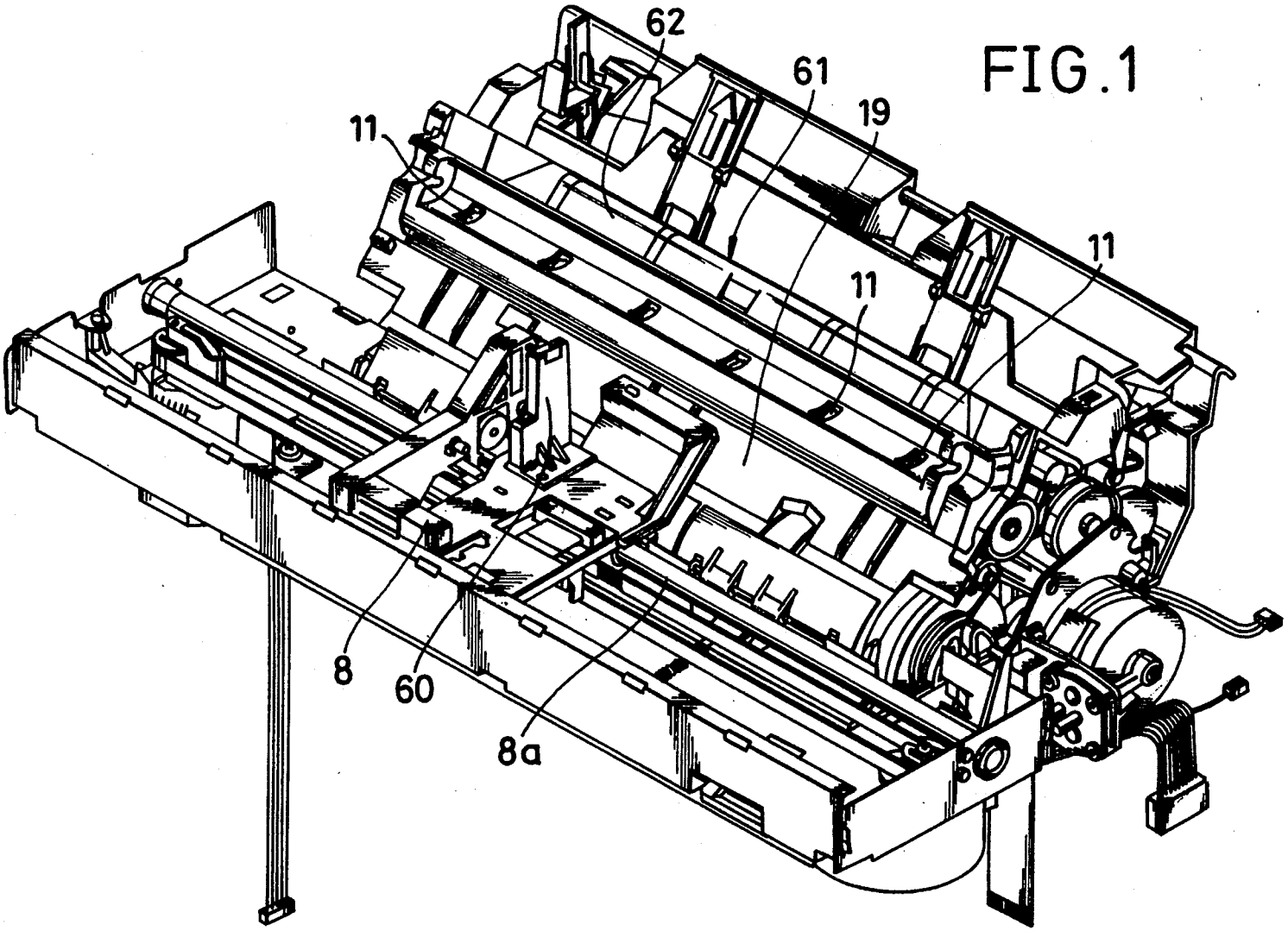
FIG. 1 is a perspective view of an ink-jet printer incorporating a sheet delivery mechanism in a first embodiment according to the present invention.

Referring to FIG. 1, a carriage 8 having a head holding unit 60 for holding an cartridge type ink-jet print head 2 is supported for sliding on a carriage guide shaft 8*a*. A feed roller 3 consisting of three sections is extended for rotation about an axis parallel to that of the carriage guide shaft 8*a*. A detachable sheet guide unit 61 is disposed above the feed roller 3. The sheet guide unit 61 comprises, in an integral unit, six delivery rollers 11, six pressure rollers 12, four sheet transfer arms 21, i.e., sheet delivery means, a sheet curling device 50, and a sheet guide 19 serving also as a platen. When the sheet guide unit 61 is disposed in place, the sheet guide 19 is positioned opposite to the ink-jet print head 2. The sheet guide unit 61 will be described in detail later.

The outer circumference of each pressure roller 12 is formed in a saw-toothed surface having a small contact area to prevent the transfer of the ink from a printed sheet P to the pressure roller 12. The pressure rollers 12 are supported for rotation on a shaft 12*a* included in the sheet guide unit 61. The pressure rollers 12 are arranged at equal intervals along the width of the printed sheet P to press the printed sheet P against the delivery rollers 11. The plurality of pressure rollers 12 are necessary to prevent the smearing of the sheet P with the ink and the like resulting from the interference between the sheet P and the component parts, such as the cartridge of the ink-jet print head 2, due to the deformation of the sheet P, such as wavy deformation.

After the trailing edge of the printed sheet P has arrived at the delivery rollers 11, the sheet transfer arms 21 are turned by a transfer arm driving device, not shown, to push the trailing edge of the printed sheet P with their sheet pushing portions 23 to transfer the printed sheet P to a printed sheet storage unit 15. After transferring the printed sheet P to the printed sheet storage unit 15, the sheet transfer arms 21 return to their standby position.

Figure 2:
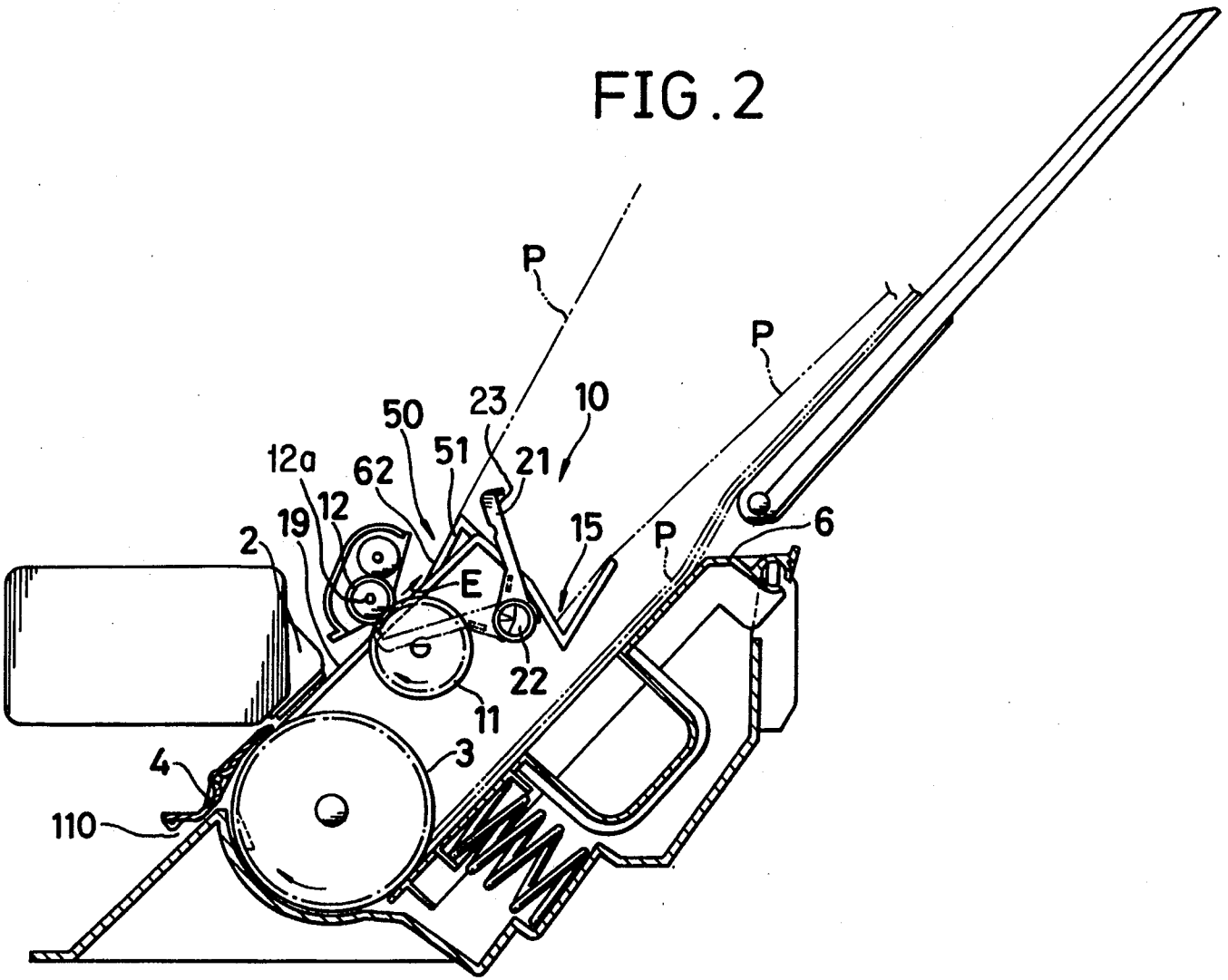
FIG. 2 a longitudinal sectional view of parts forming a sheet passage and parts arranged around the sheet passage.
Figure 3:
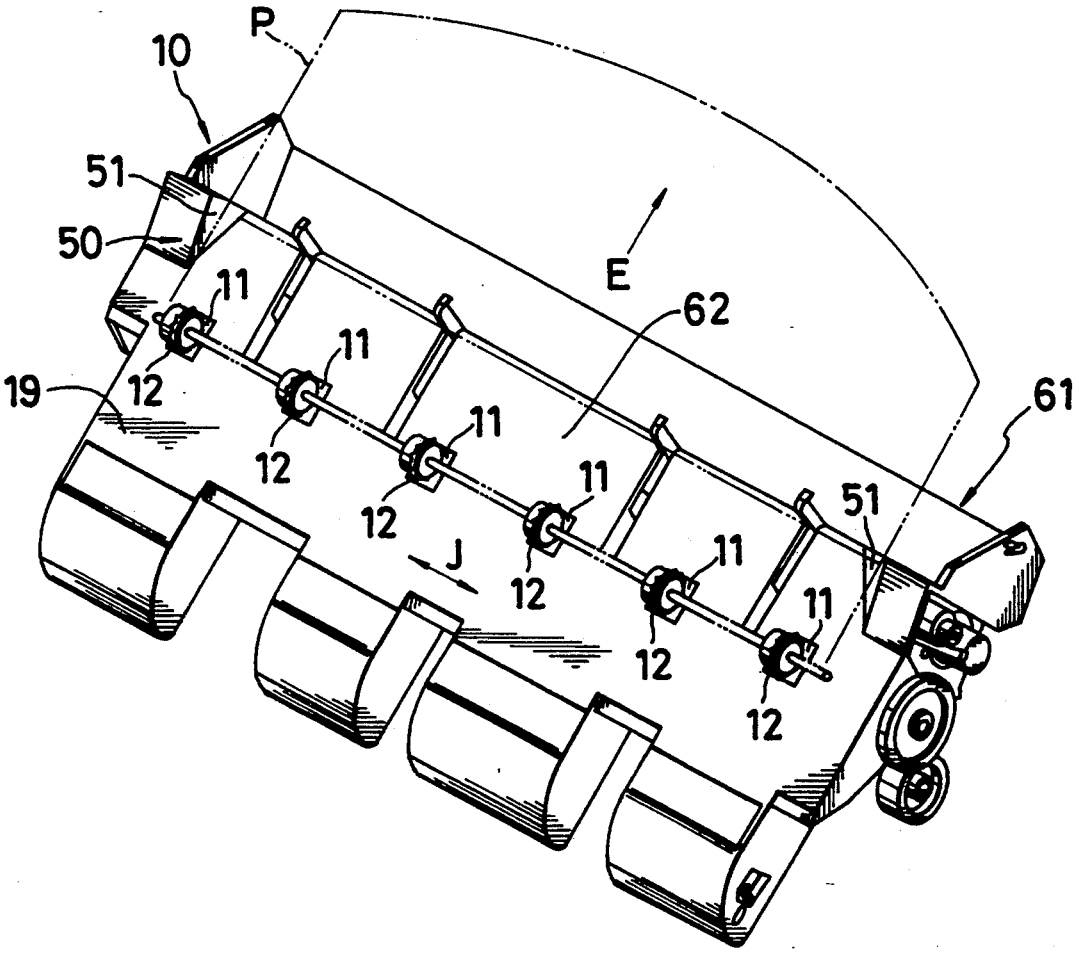
FIG. 3 is a perspective view of a sheet guide.
Figure 4:
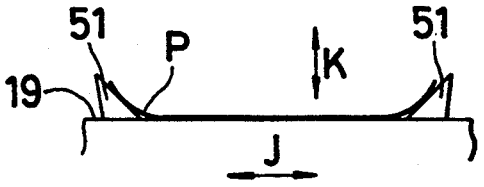
FIG. 4 is a plan view of a sheet curling device, i.e., a sheet curling means, as viewed from behind the same.
Figure 5:
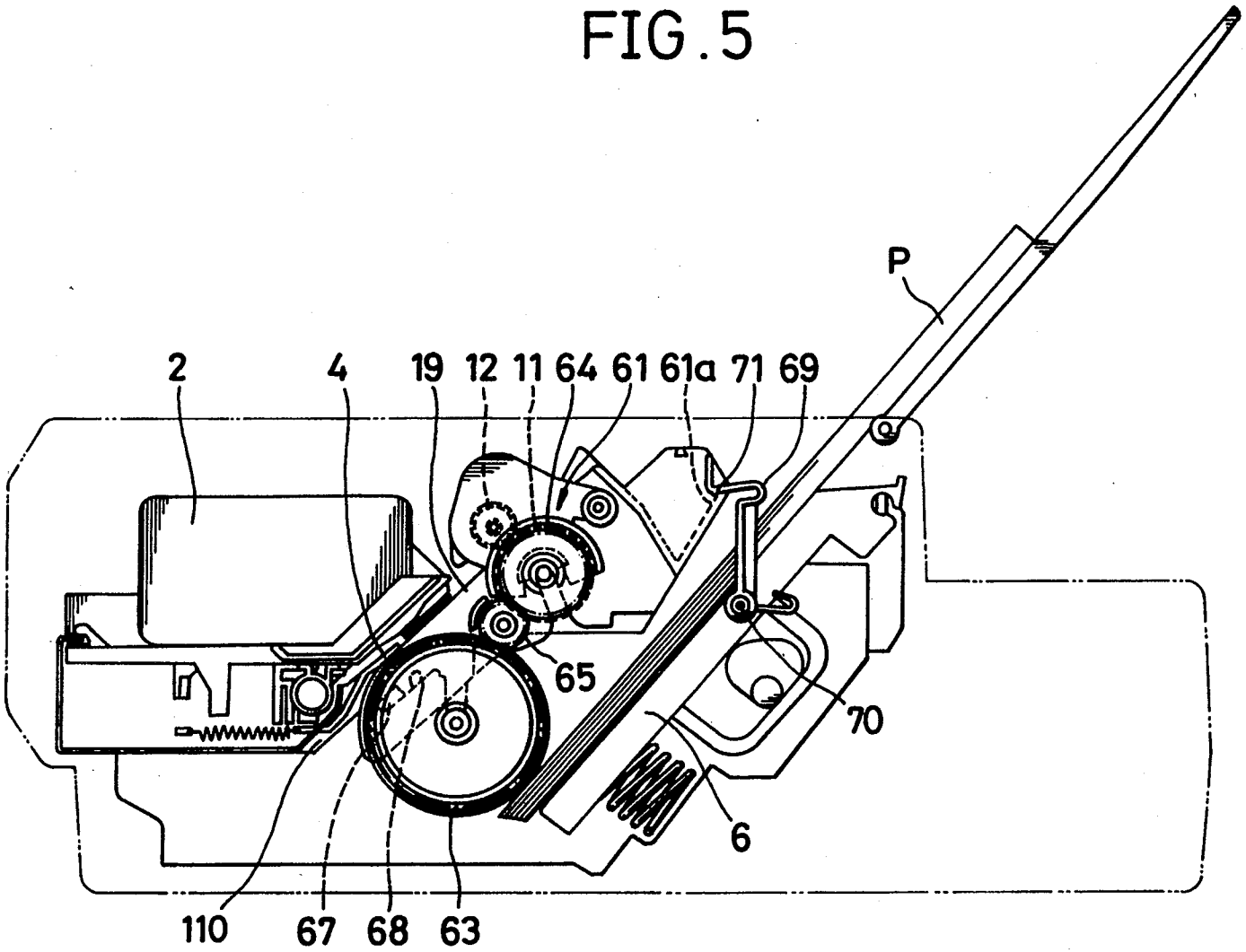
FIG. 5 is a longitudinal sectional view of the ink-jet printer, in which the ink-jet printer is provided with a sheet guide unit.

The sheet curling device 50 is disposed between the delivery rollers 11 and the printed sheet storage unit 15 on a sheet passage 103 to curl the printed sheet P delivered by the delivery rollers 11 in a direction perpendicular to a delivering direction indicated by the arrow E in FIG. 2. As shown in FIG. 3, the sheet curling device 50 of the first embodiment has sheet curling members 51. As shown in FIGS. 3 and 4, each sheet curling member 51 has an inclined surface inclined to the sheet delivering direction indicated by the arrow E, an inclined surface inclined to the direction of the arrow J parallel to the axis of the deliver rollers 11, and an inclined surface inclined to a direction indicated by the arrow K perpendicular to the directions indicated by the arrows E and J. The sheet curling members 51 are disposed opposite to each other. The distance between the respective portions of the sheet curling members 51 with which the sheet P comes into contact first is substantially equal to the width of the sheet P. The distance between the corresponding portions of the sheet curling members 51 decreases toward the back.

A portion of the sheet guide 19 extends to a portion of the sheet passage 103 between the delivery rollers 11 and the printed sheet storage unit 15, and a back guide surface 62 is formed in that portion. The sheet curling members 51 of the sheet curling device 50 are formed on the back guide surface 62.

A mechanism for detachably mounting the sheet guide unit 61 on the ink-jet printer will be described hereinafter. Referring to FIGS. 5 to 8, a delivery roller gear 64 and an idle gear 65 for transmitting the rotation of a feed roller gear 63 coaxially fixed to the feed roller 3 to the delivery rollers 11 are supported one one side wall of the sheet guide unit 61. The delivery roller gear 64 is fixed to the shaft supporting the delivery rollers 11.

The sheet guide unit 61 is set detachably on the main frame of the ink-jet printer by a setting device 66. The setting device 66 comprises positioning projections 67 projecting from the opposite side walls of the sheet guide unit 61, guide rails 68 formed on the main frame of the ink-jet printer, and sheet guide stoppers 69 formed on the main frame of the ink-jet printer. The positioning projections 67 slide along the guide rails 68 to position the sheet guide unit 61 at a predetermined position, where the feed roller gear 63 and the idle gear 65 engage. The sheet guide stoppers 69 retain the sheet guide unit 61 positioned at the predetermined position. The sheet guide stoppers 69 are supported pivotally by a shaft 70 on the main frame. A retaining finger 71 having a projection capable of engaging with the rear end 61*a* of the sheet guide unit 61 is formed on the free end of each sheet guide stopper 69.

The printed sheet P delivered by the delivery rollers 11 is pushed backward at its trailing edge by the sheet pushing portions 23 of the turning sheet transfer arms 21 into the printed sheet storage unit 15. The printed sheet P is not transferred directly to the printed sheet storage unit 15; the printed sheet P is transferred along the back guide surface 62 to the printed sheet storage unit 15. Accordingly, the printed sheet P is transferred to the printed sheet storage unit 15 in a time period longer than a time period in which the printed sheet P may be transferred directly to the printed sheet storage unit 15 by a time period necessary for the printed sheet P to move along the back guide surface 62 and, consequently, the ink printed on the printed surface of the preceding printed sheet P previously transferred to the printed sheet storage unit 15 is dried up before the succeeding printed sheet P is transferred to the printed sheet storage unit 15 and hence the printed sheets P are never smeared with the ink.

The sheet P is curled in a direction perpendicular to the sheet delivering direction indicated by the arrow E in FIG. 4 by the sheet curling device 50. FIG. 4 shows the curled sheet P as viewed along the sheet delivering direction. When the sheet P is thus curled, the second moment of area of the sheet P is increased to enhance the resistance of the sheet P against bending in the direction of the length of the sheet P, i.e., the direction of the arrow E. Accordingly, the sheet P will not be caused to droop by gravity on the printed sheet storage unit 15 and restrained from sliding along the printed surface of the preceding printed sheet P stored in the printed sheet storage unit 15. Therefore, even if the ink printed on the preceding printed sheet P has not been dried or fixed perfectly, the printed surface of the preceding printed sheet P will never be smeared by the succeeding printed sheet P.

Since the printed sheet storage unit 15 stores the printed sheets P in an inclined position and the sheet passage 103 has a substantially U-shaped shape, the area of the projection of the sheets P stored in the sheet feed tray and the printed sheet storage unit 15 on a horizontal plane is smaller than the area of the sheets P, so that the area required to install the ink jet printer is relatively small.

Thus, the ink-jet printer can be formed in a small size, the smearing of the printed surfaces of the printed sheets P is prevented and the sheets P can be smoothly delivered.

Since the sheet guide unit 61 comprises the delivery rollers 11, the pressure rollers and the associated parts in an integral unit, the ink-jet printer can be easily assembled.

Figure 6:
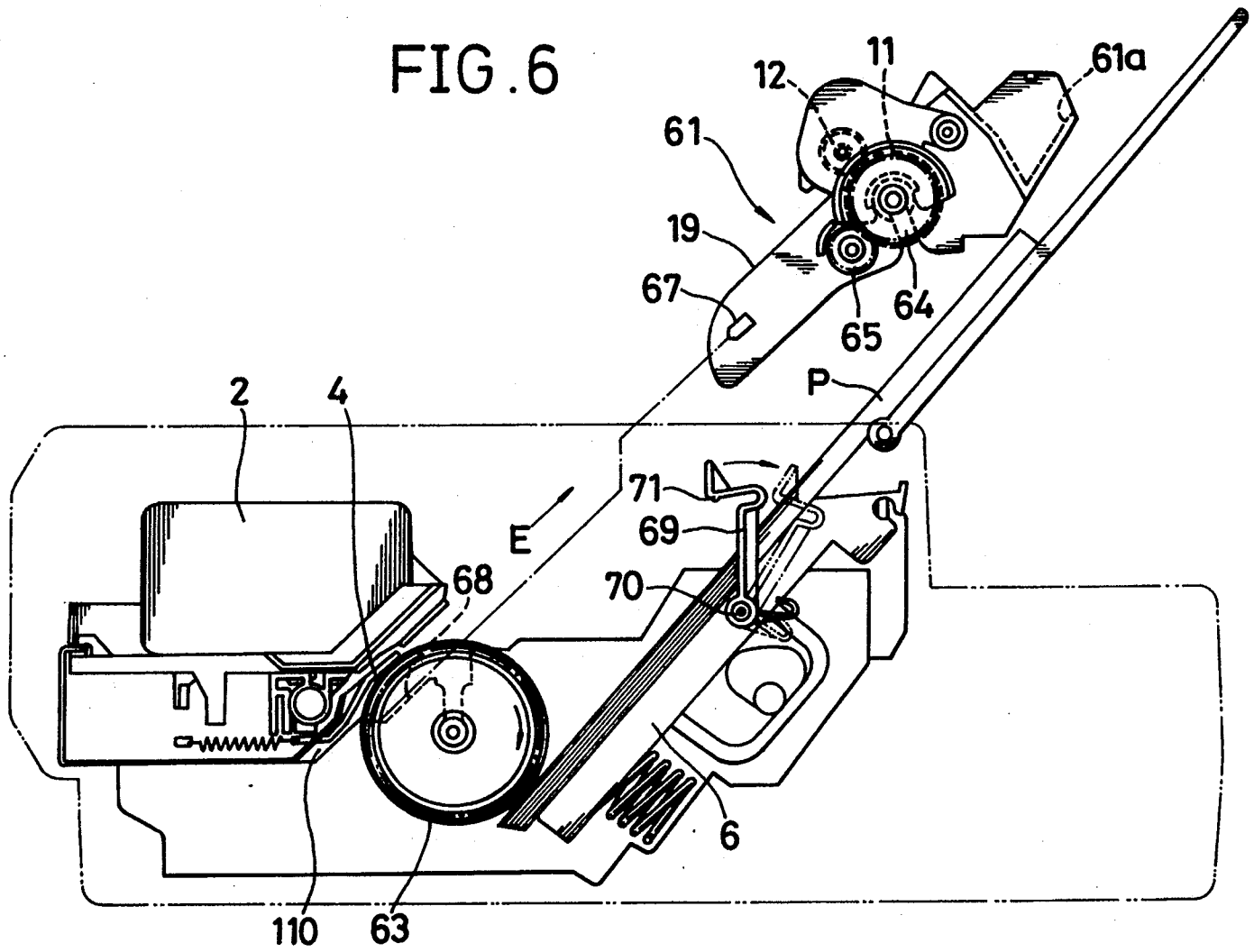
FIG. 6 is a longitudinal sectional view of the ink-jet printer, in which the sheet guide unit is removed from the ink-jet printer.
Figure 7:
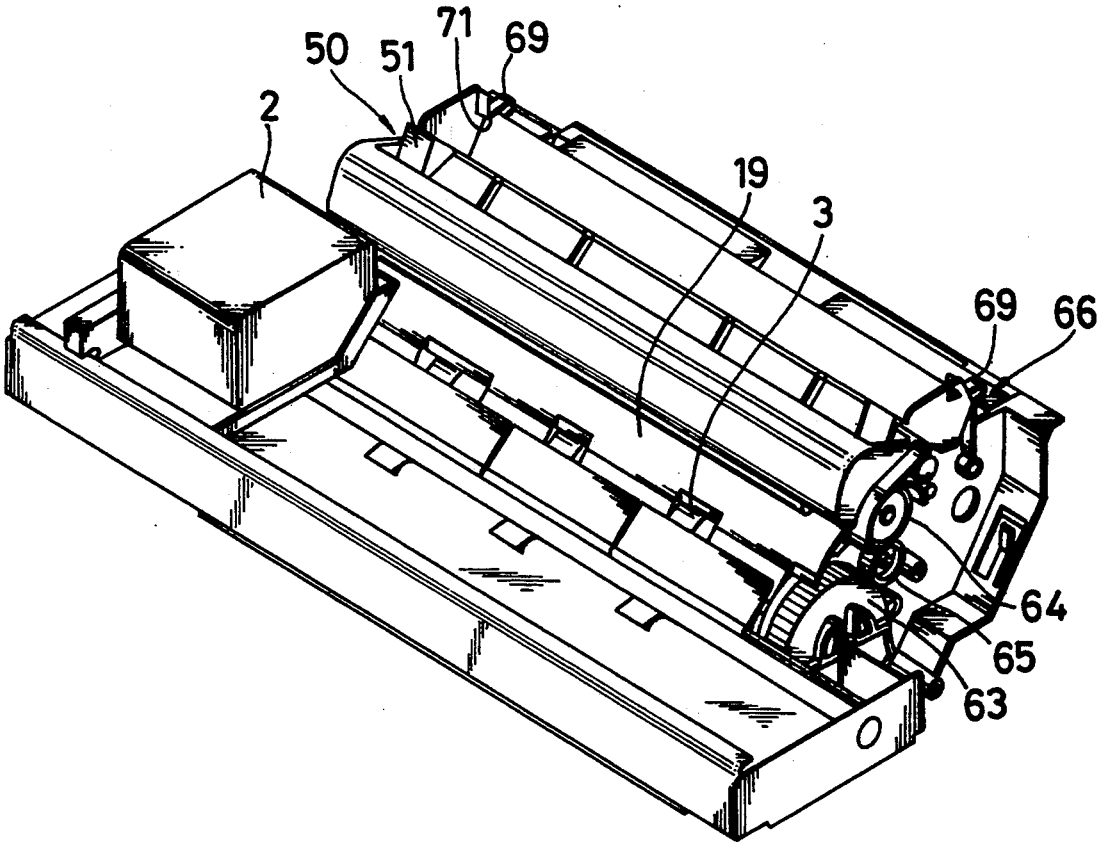
FIG. 7 is a perspective view of the ink-jet printer, showing the interior of the ink-jet printer provided with the sheet guide unit.
Figure 8:
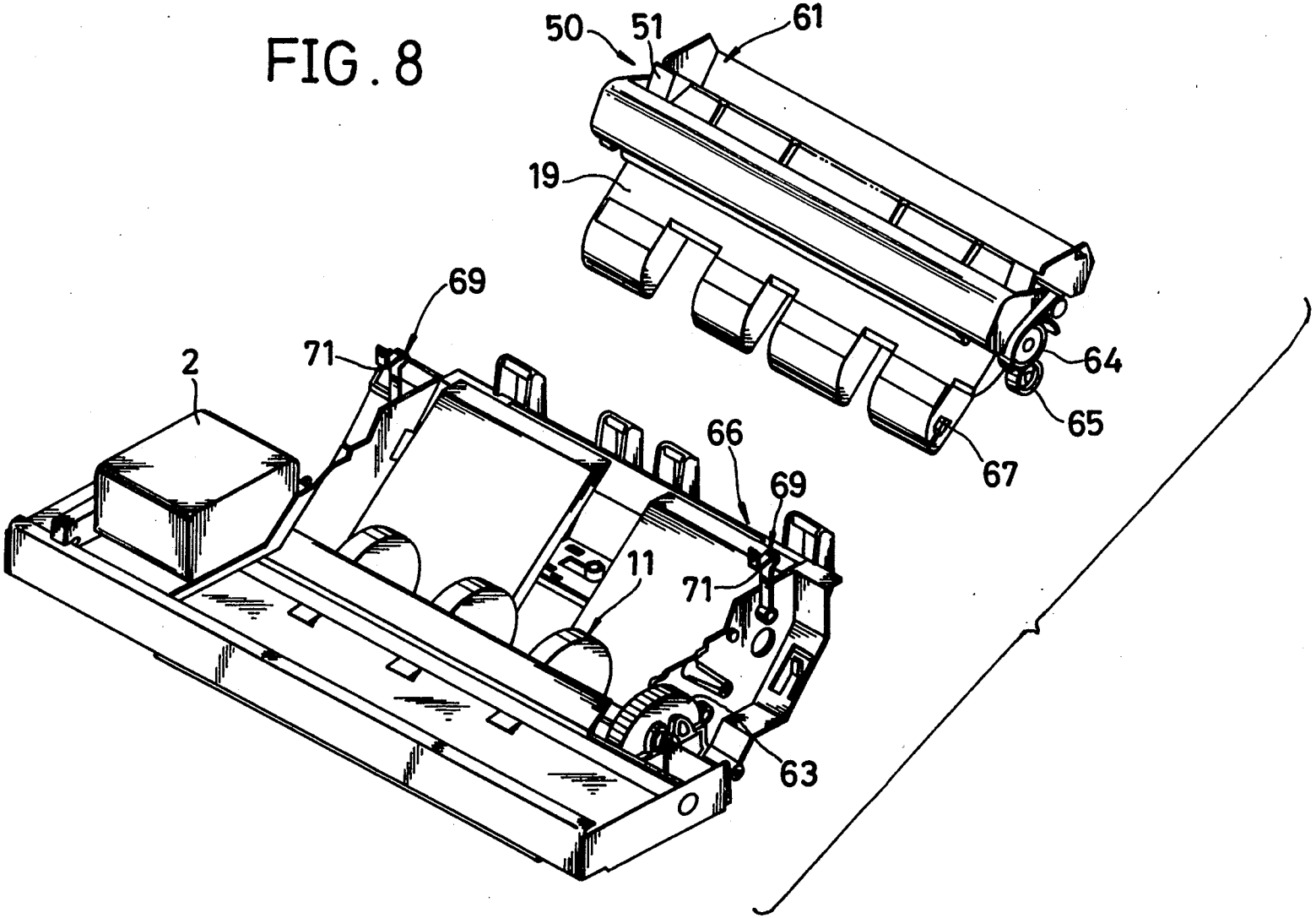
FIG. 8 is a perspective view of the ink-jet printer, showing the interior of the ink-jet printer, in which the sheet guide unit is removed.

Furthermore, since the sheet guide unit 61 is detachable from the ink-jet printer, sheets P jamming the sheet passage 103 can be easily removed. When removing the sheet guide unit 61 from the ink-jet printer, the sheet guide stoppers 69 are turned to disengage the retaining fingers 71 from the rear end 61*a* of the sheet guide unit 61 and the sheet guide unit 61 is pulled out from the ink-jet printer. When the sheet guide unit 61 is pulled out, the positioning projections 67 slides along the guide rails 68 formed on the main frame of the ink-jet printer, so that the sheet guide unit 61 can be smoothly pulled out. FIG. 6 shows the sheet guide unit 61 pulled out from the ink-jet printer. When the sheet guide unit 61 is thus removed from the ink-jet printer, sheets P jamming the sheet passage can be recognized and the jamming sheets P can be easily removed. Since the feed roller 3 consists of three sections, wide spaces for moving the hand are secured to further facilitate removing the jamming sheets. When mounting the sheet guide unit 61 on the ink-jet printer, the sheet guide unit 61 is inserted in the main frame so that the positioning projections 67 slide along the guide rails 68 and the retaining fingers 71 of the sheet guide stoppers 69 are brought into engagement with the rear end 61*a*. Thus, the sheet guide unit 61 is positioned and held in place so that the feed roller gear 63 and the idler gear 65 engage.

Since the sheet curling members 51 of the sheet curling device 50 are formed on the back sheet guide surface 62, the sheet P is curled by the sheet curling device 50 after the sheet P has passed the delivery rollers 11. Therefore, the sheet P is not curled at a position corresponding to the delivery rollers 11 and the pressure rollers 12 and the pressure rollers 12 are not lifted up by the curled sheet P. Thus, the sheet P is transferred surely by the delivery roller 11 to the printed sheet storage unit 15.

Figure 9:
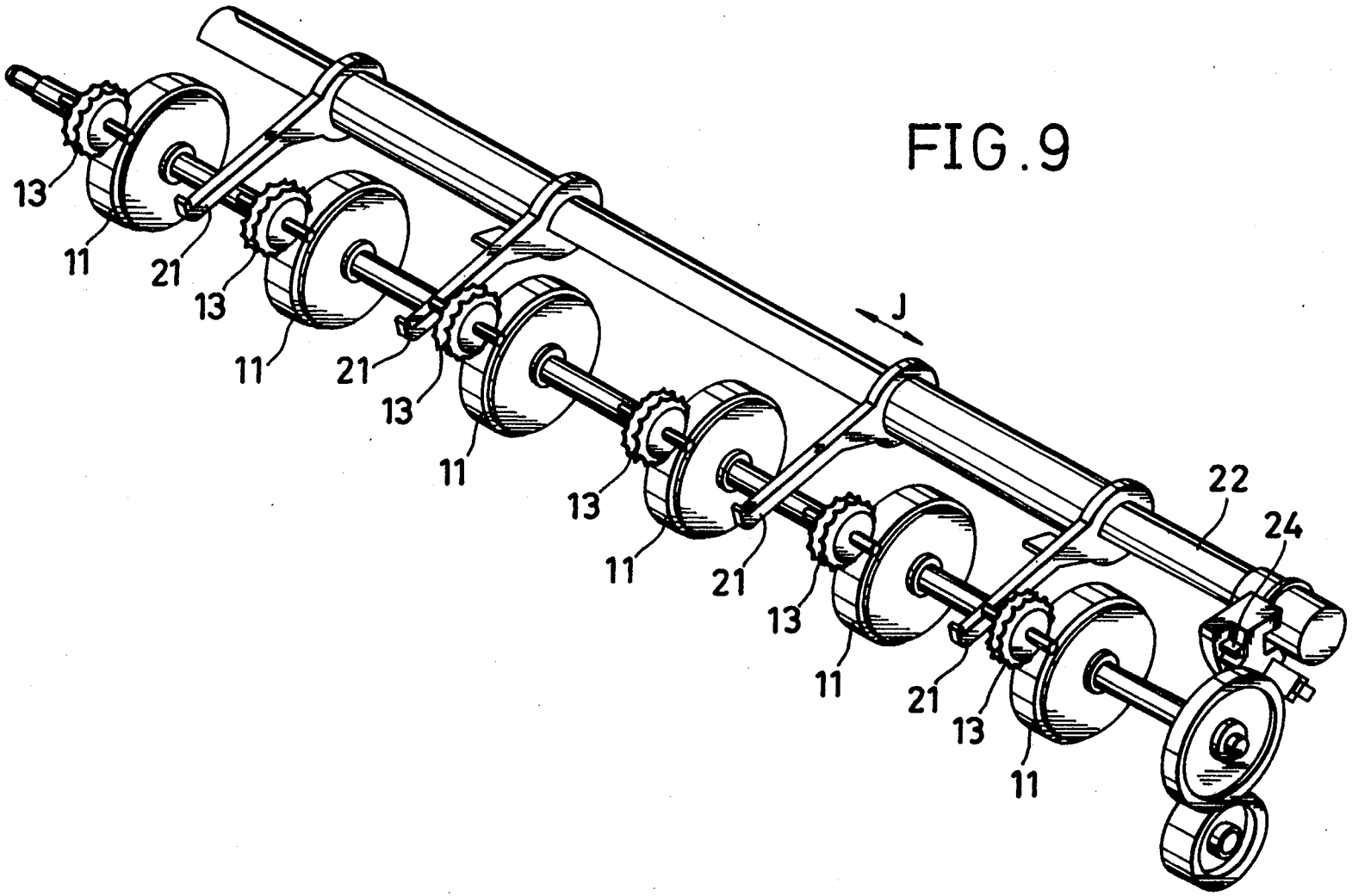
FIG. 9 is a perspective view of a sheet delivery mechanism in a second embodiment according to the present invention, showing the positional relation between pressure rollers and delivery rollers.
Figure 10:
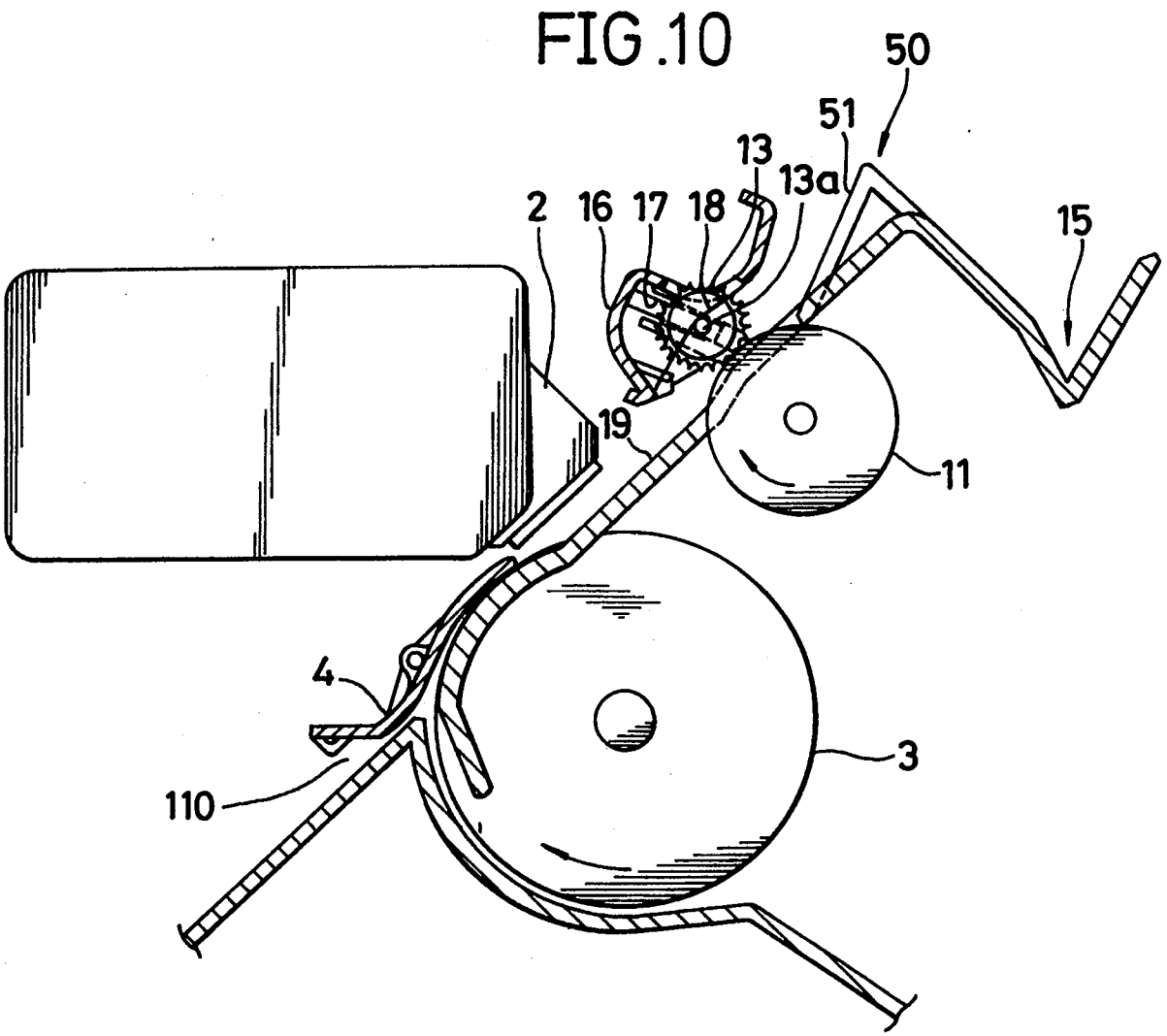
FIG. 10 is a longitudinal sectional view showing the positional relation between the pressure rollers and the delivery rollers.
Figure 11:
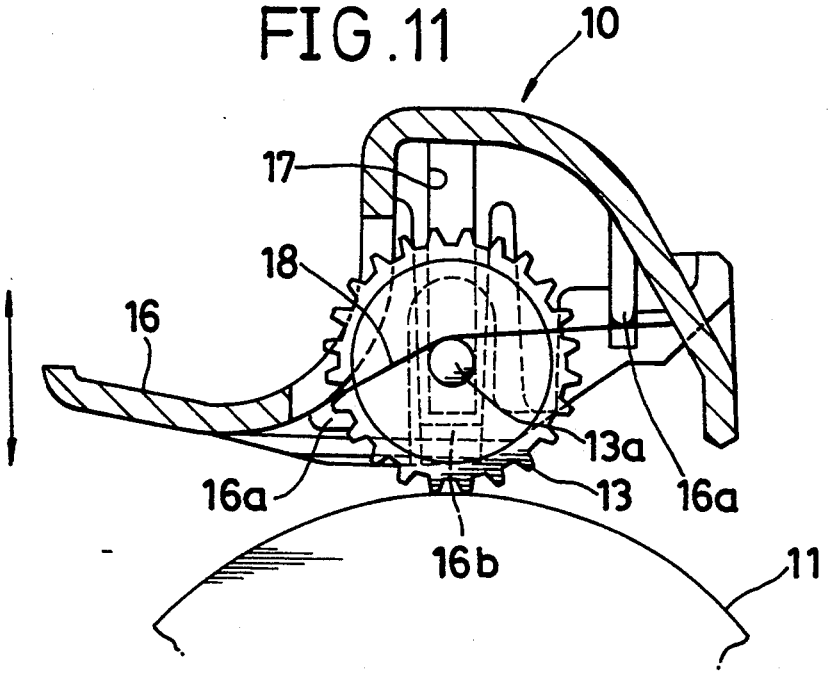
FIG. 11 is a longitudinal sectional view of a pressure roller holding structure.
Figure 12:
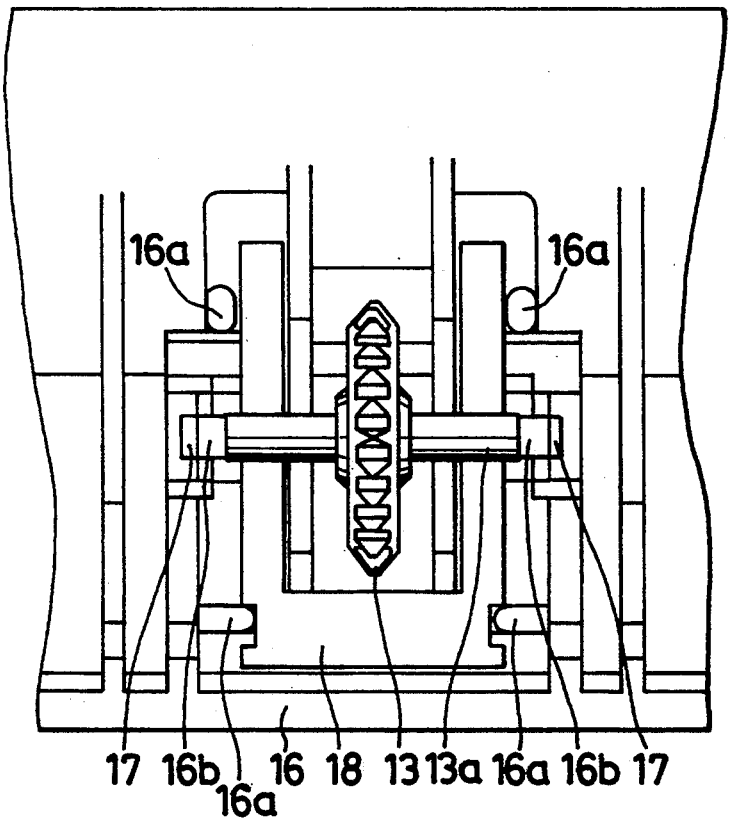
FIG. 12 is a bottom view of the pressure roller holding structure.

A sheet delivery mechanism in a second embodiment according to the present invention will be described hereinafter with reference to FIGS. 9 to 12. In the second embodiment, pressure rollers 13 are arranged at predetermined intervals along a direction parallel to the common axis of delivery rollers 11, i.e., along the direction of the arrow J, and supported individually in contact with delivery rollers 11, respectively, as shown in FIG. 9.

More concretely, each pressure roller 13 has an integral shaft 13*a*, and the opposite ends of the shaft 13*a* are slidably fitted in grooves 17 formed in a roller holder 16. The pressure roller 13 and the shaft 13*a* may be separate members. The roller holder 16 is detachably joined to a predetermined portion of a sheet guide unit 61.

Thus, the pressure rollers 13 can be individually moved toward and separated from the corresponding delivery rollers 11.

Each pressure roller 13 is pressed against the corresponding delivery roller 11 by a predetermined pressure applied thereto by a plate spring 18. The plate spring 18 is attached to the roller holder 16 so as to press the shaft 13*a* toward the delivery roller 11, allowing the free rotation of the shaft 13*a*. The respective positions of the right and left recesses formed in the right and left edges of the spring plate 18 and the opposite side edges of the spring plate 18 are determined by projections 16*a* formed on the roller holder 16. When the pressure roller 13 is put on the roller holder 16, the spring plate 18 is flexed and does not fall off the roller holder 16.

The roller holder 16 is provided with a plurality of projections 16*b* to keep the pressure roller 12 in place when the roller holder 16 is removed from the sheet guide unit 61.

When the printed sheet P is a stiff sheet, such as a thick paper sheet or an envelope, a portion of the sheet P extending before a sheet curling device 50 is curled considerably as well as a portion of the sheet P extending after the sheet curling device 50. Accordingly, in some cases, the pressure rollers 13 pressing the side portions of the sheet P, which are curled greatly, among the pressure rollers 13 are lifted up by the curled side portions of the sheet P and the curled side portions of the sheet P are not pressed firmly against the delivery rollers 11. However, the other pressure rollers 13 presses the sheet P firmly against the delivery rollers 11 without being adversely affected by the lifted pressure rollers 13 and hence the printed sheet P can be surely advanced by the delivery rollers 11.

Accordingly, the printed surface of the printed sheet P is not smeared even if the printed sheet P is a stiff one and the printed sheet P can be smoothly delivered.

A sheet delivery mechanism in a third embodiment according to the present invention will be described hereinafter with reference to FIGS. 13 to 15. The third embodiment is featured by an arm driving mechanism 30 for driving sheet transfer arms 21. The sheet transfer arms 21 are turned to push the sheet P at its trailing edge, after the trailing edge of the sheet P has reached delivery rollers 11, to transfer the sheet P to a printed sheet storage unit 15, and returned to their standby positions indicated by alternate long and two short dashes lines in FIG. 2 after transferring the sheet P to the printed sheet storage unit 15. Each of the sheet transfer arms 21 has a base end supported for turning on a shaft 22 and provided with a driven sector gear 24, and a free end having a sheet pushing portion 23.

Each sheet transfer arm 21 is urged toward its standby position, i.e., in the direction of the arrow H (FIG. 13), by a spring 27, i.e., a biasing means.

Each sheet transfer arm 21 abuts on and is positioned at the standby position by a positioning member 29, i.e., a positioning means.

Figure 13:
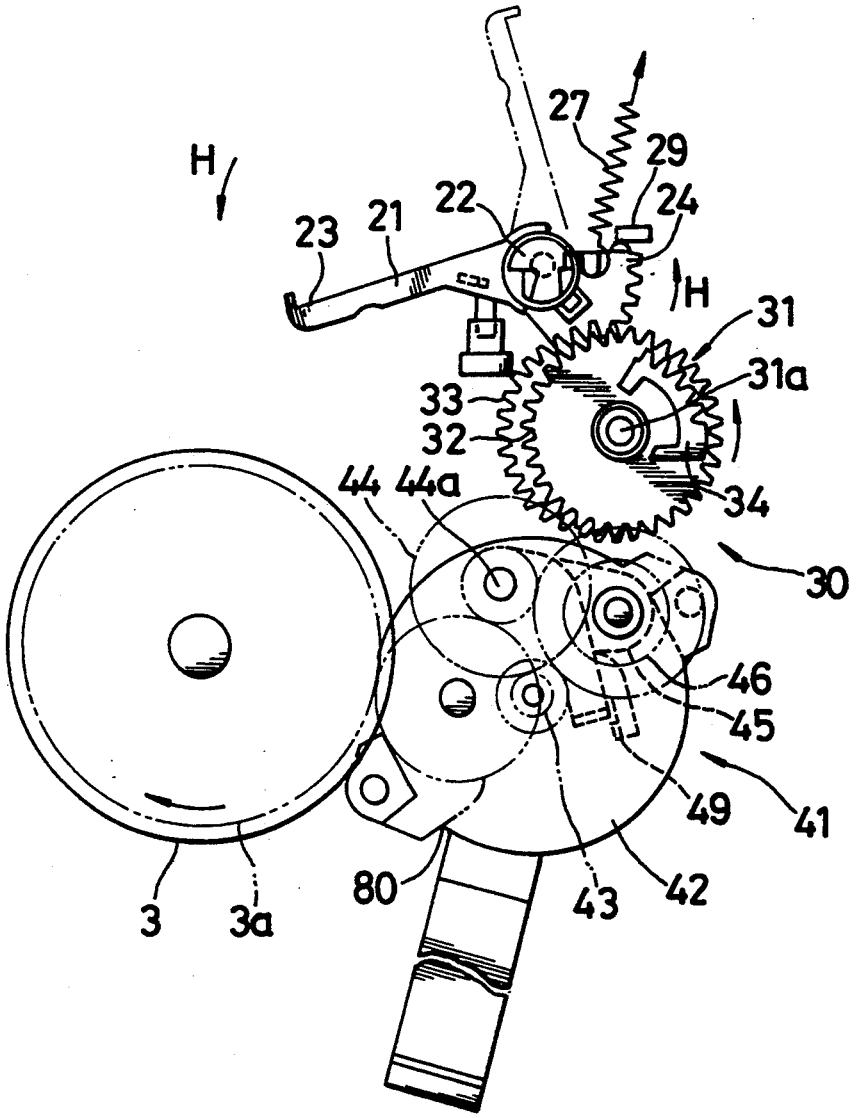
FIG. 13 is a side view of a sheet transfer arm and a transfer arm driving mechanism included in a sheet delivery mechanism in a third embodiment according to the present invention.
Figure 14:
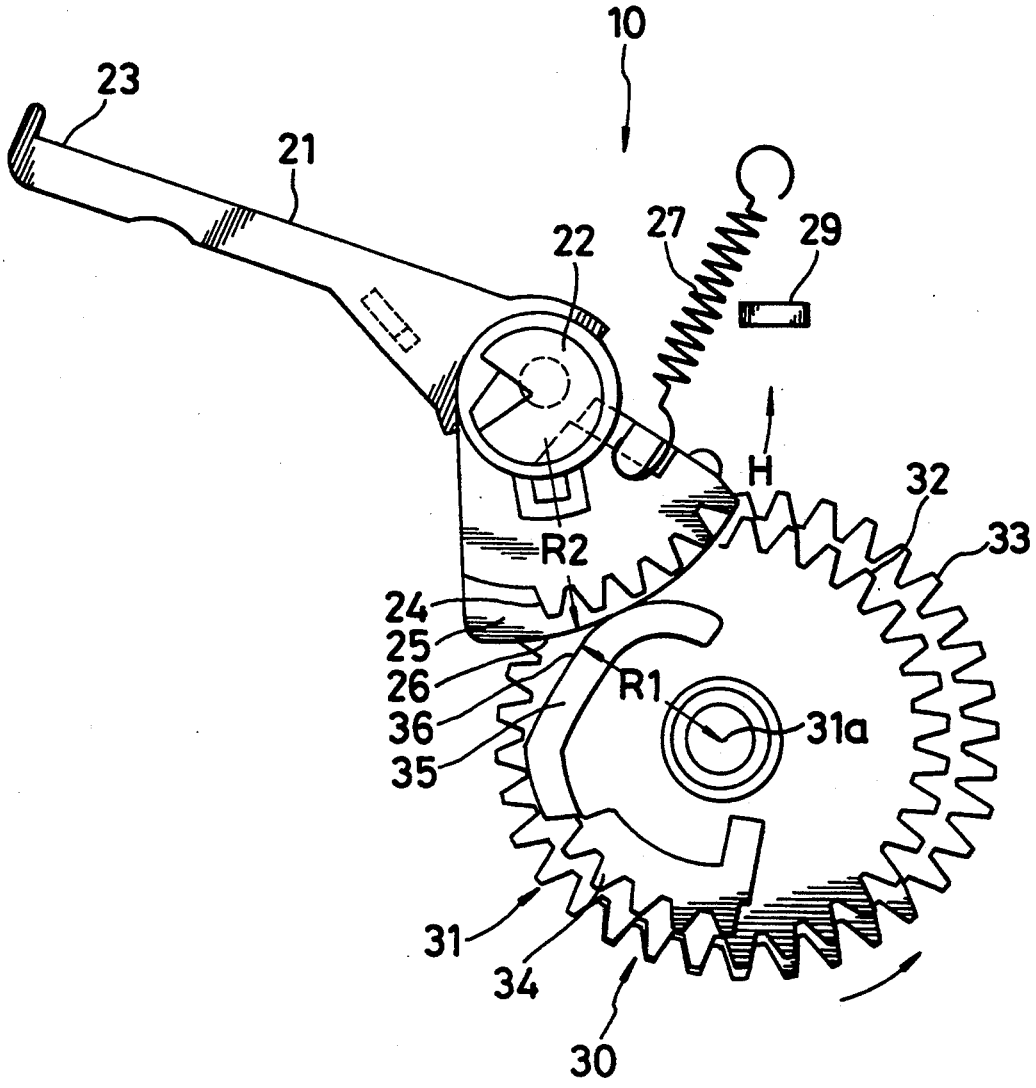
FIG. 14 is a side view of the sheet transfer arm and a rotary member.
Figure 15A:
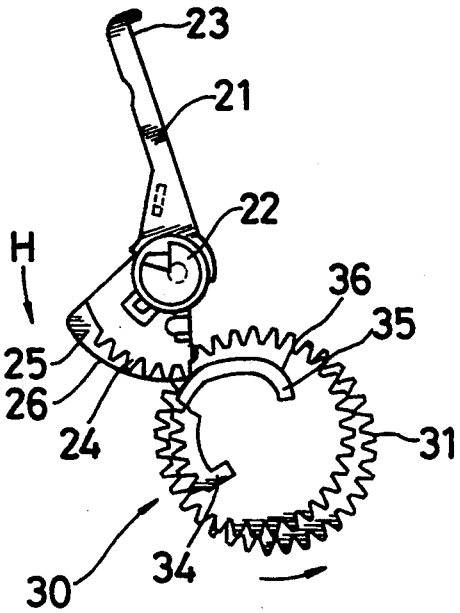
FIGS. 15(*a*), 15(*b*), 15(*c*) and 15(*d*) are side views of assistance in explaining the sheet delivering operation of the sheet transfer arm.
Figure 15B:
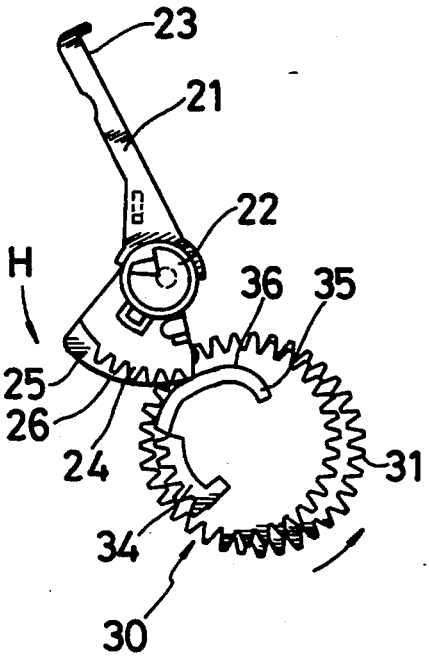
Figure 15C:
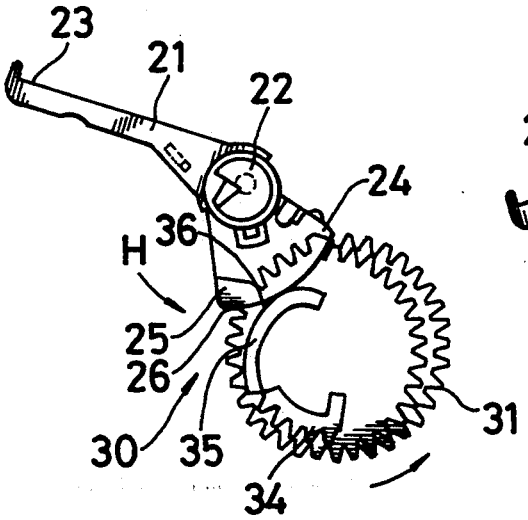
Figure 15D:
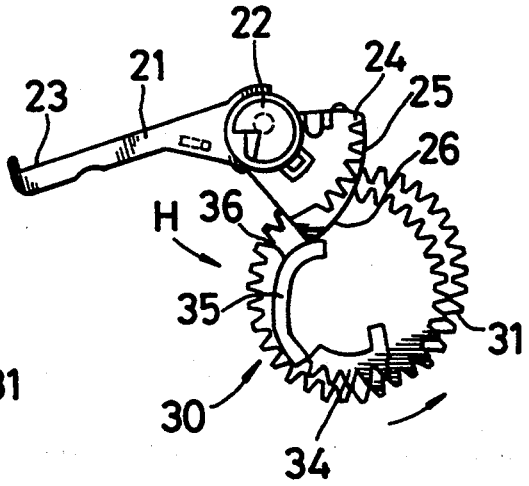

As shown in FIG. 13, the arm driving mechanism 30 comprises a gear wheel 31 provided with a driving sector gear 34 engaged with the driven sector gear 24 of the sheet transfer arm 21 to turn the sheet transfer arm 21 through a predetermined angle in a direction opposite the direction in which the sheet transfer arm 21 is urged by the spring 27, i.e., the direction of the arrow H (FIG. 13) and capable of turning about an axis 31*a*, and a driving gear mechanism 41 for turning the gear wheel 31 in a predetermined direction (in this embodiment, a counterclockwise direction as viewed in FIG. 13). As shown in FIG. 14, the gear wheel 31 is provided with a first cam 35 at a position after the driving sector gear 34 with respect to the predetermined turning direction. The first cam 35 has a cam surface 36 defined by a curve of successive points at distance R1 from the axis 31*a* decreasing with angle measured in the direction of turning. The gear wheel 31 is provided with a first gear portion 32 and a second gear portion 33 in addition to the driving sector gear 34.

The sheet transfer arm 21 is provided on its base end with a second cam 25 having a cam surface 26 in contact with the cam surface 36 of the first cam 35 and defined by a curve of successive points at distance R2 from the shaft 22 continuously increasing with angle measured in the direction in which the sheet transfer arm 21 is biased by the spring 27, i.e., the direction of the arrow H (FIG. 13). The cams 25 and 35 are separated from each other when the sheet transfer arm 21 is returned to the standby position.

The driving gear mechanism 41 has a single motor 42 for selectively driving either the feed roller 3 or the sheet transfer arms 21.

More concretely, the driving gear mechanism 41 comprises a pinion 43 mounted on the output shaft of the motor 42, a sun gear 44 engaged with the pinion 43, a swing member 45 supported for swing motion about the axis 44*a* of the sun gear 44 in either one or the other direction depending on the direction of rotation of the sun gear 44, a planet gear 46 supported on one end of the swing member 45 so as to be in engagement with the sun gear 44 and to engage with the gear wheel 31 when the sun gear 44 is rotated in the normal direction, i.e., in a counterclockwise direction as viewed in FIG. 13, and a feed gear 80 which transmits the rotation of the sun gear 44 to the feed roller 3, i.e., to a gear 3*a* fixed to the feed roller 3, when the sun gear is rotated in the reverse direction. The feed gear 80 is a one-way gear which rotates only when the output shaft of the motor 42 rotates in the reverse direction, i.e., in a counterclockwise direction as viewed in FIG. 13, to rotate the feed roller 3 clockwise.

The range of swing motion of the swing member 45 is limited by a stopper 49. The motor 42 is controlled for operation in the normal direction or the reverse direction by a predetermined procedure by a motor control means, not shown. In this embodiment, the motor control means is part of a main controller for controlling the ink-jet printer.

The sun gear 44 is rotated counterclockwise when the pinion 43 is rotated clockwise, as viewed in FIG. 13, by the motor 42. Then, the swing member 45 turns counterclockwise about the axis 44*a* to bring the planet gear 46 and the gear wheel 31 into engagement and, consequently, the gear wheel 31 is rotated counterclockwise. In this state, any rotative driving force is not transmitted through the feed gear 80 to the feed roller 3 and hence the feed roller 3 remains stationary.

The sun gear 44 is rotated clockwise when the pinion 43 is rotated counterclockwise by the motor 42. Then, the swing member 45 turns clockwise about the axis 44*a* to disengage the planet gear 46 from the gear wheel 31. Consequently, any rotative driving force is not transmitted to the gear wheel 31 to hold the gear wheel 31 stationary and, on the other hand, rotative driving force is transmitted through the feed gear 80 to the feed roller 3 to rotate the feed roller 3 clockwise.

The printed sheet P on which specified matters have been printed with the ink-jet print head 2 is pressed against the delivery rollers 11 by the pressure rollers 12 and advanced in the sheet delivering direction indicated by the arrow E in FIG. 2. After the arrival of the trailing edge of the printed sheet P at the delivery rollers 11, the arm driving mechanism 30 drives the sheet transfer arms 21 to push the printed sheet P at its trailing edge with the sheet pushing portions 23 of the sheet transfer arms 21 into the printed sheet storage unit 15. After pushing the printed sheet P into the printed sheet storage unit 15, the sheet transfer arms 21 are returned to the standby position indicated by alternate long and two short dashes lines in FIG. 2 by the arm driving mechanism 30.

More concretely, after the arrival of the trailing edge of the printed sheet P at the delivery rollers 11, the driving gear mechanism 41 turns the gear wheel 31 of the arm driving mechanism 30 in a predetermined direction, i.e., in a counterclockwise direction as viewed in FIG. 13. Then, the driving sector gear 34 of the gear wheel 31 and the driven sector gear 24 of the sheet transfer arm 21 are engaged and the sheet transfer arm 21 is turned by the gear wheel 31 on the shaft 22 through a predetermined angle against the resilience of the spring 27 (FIGS. 15(*a*) and 15(*b*)) to push the printed sheet P at its trailing edge with the sheet pushing portion 23 into the printed sheet storage unit 15.

As the gear wheel 31 rotates, the driving sector gear 34 and the driven sector gear 24 are disengaged. Then, the sheet transfer arm 21 is turned by the resilience of the spring 27 toward the standby position, i.e., in the direction of the arrow H (FIG. 13) until the same is stopped by the positioning member 29 (FIGS. 15(*c*) and 15(*d*)). During the turning of the sheet transfer arm 21 toward the standby position, the cam surface 36 of the first cam 35 of the gear wheel 31 is sliding contact with the cam surface 26 of the second cam 25 of the sheet transfer arm 21 to restrain the sheet transfer arm 21 from rapid turning toward the standby position.

Thus the collision of the sheet transfer arm 21 with the positioning member 29 is avoided and hence the generation of noise is prevented. Since the breakage of the sheet transfer arm 21 is prevented by avoiding the collision between the sheet transfer arm 21 and the positioning member 29, the durability of the ink-jet printer is improved.

The returning speed of the sheet transfer arm 21 can be determined properly by properly designing the respective shapes of the respective cam surfaces 26 and 36 of the cams 25 and 35.

What is claimed is:

1. A sheet delivery mechanism for a printer, comprising:

a sheet passage extending from a sheet feed position via a printing position to a sheet delivery position;

delivery rollers disposed between the printing position and the sheet delivery position on one side of the sheet passage with their circumferences tangent to the sheet passage so as to be driven for rotation by a driving unit;

pressure rollers disposed on the other side of the sheet passage so as to be in contact respectively with the delivery rollers;

a printed sheet storage unit disposed at the sheet delivery position;

a back sheet guide disposed between the delivery rollers and the printed sheet storage unit on the sheet passage; and a sheet delivery means for transferring the sheet delivered by the sheet delivery rollers to the printed sheet storage unit;

wherein said sheet delivery means comprises:

sheet transfer arms each having a sheet pushing portion for pushing the sheet at its trailing edge after the trailing edge has reached the delivery rollers, and supported for turning in a range between a position corresponding to the delivery roller and a predetermined position after the delivery roller on said sheet passage so as to interfere with said sheet passage; and an arm driving means for driving the sheet transfer arms for turning after the trailing edge of the printed sheet has arrived at the delivery rollers.

2. A sheet delivery mechanism for a printer, according to claim 1, wherein said arm driving means comprises:

a shaft for supporting the sheet transfer arms for swing motion;

a biasing means for biasing the sheet transfer arms toward their standby positions;

positioning members for positioning the sheet transfer arms at their standby positions, respectively;

a driven sector gear formed integrally with each sheet transfer arm so as to be turned together with the sheet transfer arm on the shaft;

a rotary member provided with a driving sector gear capable of being engaged with the driving sector gear;

a first cam to be turned together with the rotary member and having a cam surface defined by a curve of points at a distance from an axis of rotation of the rotary member varying with an angle measured in a direction of turning; and a second cam to be turned together with the sheet transfer arm formed so as to come into engagement with the first cam when the driven sector gear and the driving sector gear are disengaged, and having a cam surface defined by a curve of successive points at distance from the axis of turning of the sheet transfer arm continuously increasing with angle measured in the direction of return turning of the sheet transfer arm.

3. A sheet delivery mechanism for a printer, according to claim 1, wherein said sheet delivery rollers, said pressure rollers and said sheet delivery means are assembled to form a sheet guide unit.

4. A sheet delivery mechanism for a printer, according to claim 3, wherein said sheet guide unit is detachably mounted on a main frame of the printer, and said sheet guide unit is positioned and detachably held at a predetermined position by a setting means.

5. A sheet delivery mechanism for a printer, according to claim 1, further comprising a sheet curling means for curling the printed sheet delivered by said sheet delivery rollers in a direction perpendicular to a delivery direction in which the printed sheet is delivered.

6. A sheet delivery mechanism for a printer, according to claim 5, wherein said sheet curling means comprises a pair of curling members disposed opposite to each other respectively at the opposite side ends of said sheet passage with a space substantially equal to the width of the sheet therebetween so that the space between the curling members decreases in the direction of delivery.

7. A sheet delivery mechanism for a printer, according to claim 5, wherein said sheet curling means is placed on a surface of said back sheet guide.

8. A sheet delivery mechanism for a printer, according to claim 5, wherein said sheet delivery rollers, said pressure rollers and said sheet curling means are assembled to form a sheet guide unit.

9. A sheet delivery mechanism for a printer, according to claim 8, wherein said sheet guide unit is detachably mounted on a main frame of the printer, and said sheet guide unit is positioned and detachably held at a predetermined position by a setting means.

10. A sheet delivery mechanism for a printer according to claim 1, wherein said pressure rollers are supported individually and placed in contact respectively with said sheet delivery rollers.

11. A sheet delivery mechanism for a printer, according to claim 1, wherein said printed sheet storage unit stores the sheets in an inclined position inclining backward from a vertical position.

12. A sheet delivery mechanism for a printer, according to claim 1, wherein said sheet passage is formed substantially in a U-shape and has a bent portion corresponding to the printing position.

13. A sheet delivery mechanism for a printer, according to claim 12, further comprising a feed roller disposed at a position corresponding to the bent portion of said sheet passage, and a hand-feed sheet passage for guiding a hand-fed sheet to the feed roller so that the hand-fed sheet is fed to the printing position on a straight line extending between the feed roller and the delivery position.

14. A sheet delivery mechanism for a printer, according to claim 13, further comprising a leaf plate disposed at a position between the junction of the sheet passage and the hand-feed sheet passage, and the printing position so as to be elastically pressed against said feed roller.

* * * * *